US008966751B2

(12) United States Patent
Takami et al.

(10) Patent No.: US 8,966,751 B2
(45) Date of Patent: Mar. 3, 2015

(54) MMC CYLINDER LINER AND METHOD FOR PRODUCING THE SAME

(75) Inventors: Toshihiro Takami, Toyota (JP); Manabu Tsukimoto, Okazaki (JP); Junichi Matsudaira, Nisshin (JP); Kunio Kumagai, Anjo (JP); Ikuo Suzuki, Toyota (JP); Makoto Fujita, Anjo (JP)

(73) Assignees: Toyota Jidosha Kabushiki Kaisha, Aichi-ken (JP); Central Motor Wheel Co., Ltd., Aichi-ken (JP)

( * ) Notice: Subject to any disclaimer, the term of this patent is extended or adjusted under 35 U.S.C. 154(b) by 956 days.

(21) Appl. No.: 13/119,857

(22) PCT Filed: Mar. 12, 2010

(86) PCT No.: PCT/JP2010/054720

§ 371 (c)(1), (2), (4) Date: Mar. 18, 2011

(87) PCT Pub. No.: WO2010/113667

PCT Pub. Date: Oct. 7, 2010

(65) Prior Publication Data

US 2011/0162521 A1 Jul. 7, 2011

(30) Foreign Application Priority Data

Mar. 31, 2009 (JP) ..... 2009-085863

(51) Int. Cl.

| | |
|---|---|
| ***B23P 11/00*** | (2006.01) |
| ***B22D 19/14*** | (2006.01) |
| ***B22D 17/10*** | (2006.01) |
| ***B22D 17/20*** | (2006.01) |
| ***B22D 19/00*** | (2006.01) |
| ***B22D 19/02*** | (2006.01) |
| ***B22D 19/16*** | (2006.01) |
| ***B22F 5/10*** | (2006.01) |
| ***C22C 49/06*** | (2006.01) |

(52) U.S. Cl.

CPC ..... *B22D 19/14* (2013.01); *B22D 17/10* (2013.01); *B22D 17/2069* (2013.01); *B22D 19/0009* (2013.01); *B22D 19/02* (2013.01); *B22D 19/16* (2013.01); *B22F 5/106* (2013.01); *C22C 49/06* (2013.01); *B22F 2207/01* (2013.01)

USPC ..... 29/888.061; 29/527.1; 29/527.5; 164/453

(58) Field of Classification Search

CPC ..... B22D 19/0009; F02B 2075/025; F02F 1/004; F02F 1/24

USPC ..... 29/888.061, 888.06, 419.1, 527.1, 29/527.5; 164/112, 453

See application file for complete search history.

(56) References Cited

U.S. PATENT DOCUMENTS 4,901,780 A 2/1990 Sasaki et al.

FOREIGN PATENT DOCUMENTS

| | | |
|---|---|---|
| DE | 10 2004 039 306 A1 | 2/2006 |
| EP | 0 301 550 A2 | 2/1989 |
| EP | 0 867 517 A1 | 9/1998 |

(Continued)

*Primary Examiner* — Ryan J Walters

(74) *Attorney, Agent, or Firm* — Sughrue Mion, PLLC

(57) ABSTRACT

An MMC cylinder liner comprises an inner tubular portion and an outer tubular portion. The inner tubular portion includes a metal matrix composite formed of a compact impregnated with an Al—Si alloy wherein the compact is made of a reinforcing material. The outer tubular portion is formed of the Al—Si alloy. The Si concentration of the Al—Si alloy impregnated into the compact of the inner tubular portion is different from the Si concentration of the Al—Si alloy of the outer tubular portion.

12 Claims, 7 Drawing Sheets

(56) References Cited

FOREIGN PATENT DOCUMENTS

| | | | |
|---|---|---|---|
| JP | 64-031565 | A | 2/1989 |
| JP | 3-3539 | B2 | 1/1991 |
| JP | 06-170515 | A | 6/1994 |
| JP | 11-222638 | A | 8/1999 |
| JP | 2003-181620 | A | 7/2003 |
| JP | 2007-508147 | A | 4/2007 |
| WO | 2005/038073 | A2 | 4/2005 |

MMC CYLINDER LINER AND METHOD FOR PRODUCING THE SAME

CROSS REFERENCE TO RELATED APPLICATIONS

This application is a National Stage of International Application No. PCT/JP2010/054720 filed on Mar. 12, 2010, which claims priority from Japanese Patent Application No. 2009-085863, filed on Mar. 31, 2009, the contents of all of which are incorporated herein by reference in their entirety.

FIELD OF THE INVENTION

This invention relates to an MMC cylinder liner comprising an inner tubular portion and an outer tubular portion, wherein the inner tubular portion includes metal matrix composite formed of a compact impregnated with an Al—Si alloy, the compact being made of a reinforcing material, and wherein the outer tubular portion is formed of the Al—Si alloy.

BACKGROUND ART

It is well known that more engine parts are made of an aluminum alloy to satisfy the requirements such as reduction in weight or improvement in heat dissipation. Parts that slide in a reciprocating way at high speed, such as a piston head and a piston ring, exert inertia force that is proportional to the mass of themselves that has significant impact on their operating characteristics. Thus, the parts of this kind have been made of aluminum alloys since the early stage to take an advantage of the reduction in weight. Recently, parts such as a cylinder head and a crankshaft have been also made lightweight.

Meanwhile, it was believed difficult to form a cylinder liner with an aluminum alloy because higher high-temperature dimensional stability, higher abrasion resistance, greater strength, and greater rigidity are required due to the size, function, and operation of the cylinder liner. Thus, a metal matrix composite (MMC), i.e., a composite based on an aluminum alloy reinforced with metal and ceramic fibers or ceramic particles has been used to reduce the weight of the cylinder liner.

Conventionally, MMC cylinder liners such as those disclosed in the JP11-222638A, JP2007-508147A, JP2003-181620A, and JP06-170515A have been known. In addition, a method for producing an MMC cylinder liner such as one disclosed in Japanese Examined Patent Publication No. 03-003539 has been known. JP11-222638A describes an MMC cylinder liner based on a hypoeutectic Al—Si alloy wherein Si concentration is between 9.6 and 12. JP2003-181620A describes an MMC cylinder liner based on a hypoeutectic Al—Si alloy such as ADC12.

JP06-170515A describes a method for producing an MMC cylinder liner comprising the steps as illustrated in FIGS. 10A-D.

1) First, metal and ceramic fibers, which form a reinforcing material together, are hardened to form a porous tubular compact 50 that is made of the reinforcing material and that has a generally circular cross-section. As illustrated in FIG. 10A, the compact 50 is fitted over a generally cylindrical core 52 provided in a movable mold 51.

2) As illustrated in FIG. 10B, the movable mold 51 is moved toward to a fixed mold 53. Then, a cavity 54 in a tubular form having a generally circular cross-section is formed around an outer periphery of the compact 50.

3) As illustrated in FIG. 10C, a melted Al—Si alloy is supplied under the pressure from a gate 55 provided in the fixed mold 53 to the cavity 54 to cause the compact 50 to be impregnated with the melted Al—Si alloy.

4) After the hardened Al—Si alloy was removed, an MMC cylinder liner as illustrated in FIG. 10D is produced. The cylinder liner includes an inner tubular portion 56 formed of a metal matrix composite and an outer tubular portion 57 formed of the Al—Si alloy.

The MMC cylinder liner as produced above is fused metallurgically with a body of a cylinder block during casting of the block.

For such MMC cylinder liners, adhesiveness to the body of the cylinder block during casting is required. As described in JP11-222638A and JP2003-181620A, when a low-hypoeutectic alloy having a low melting point is used as an Al—Si alloy forming an MMC cylinder liner, adhesiveness of the cylinder liner to the cylinder block is ensured. However, in that case, mechanical characteristics required for the inner peripheral surface of the cylinder liner that serves as a sliding surface of a piston may not be achieved. This may cause decrease in durability or add the necessity of further reinforcement with an increased amount of the reinforcing material.

SUMMARY OF THE INVENTION

Accordingly, it is an objective of the present invention to provide an MMC cylinder liner that satisfies both the mechanical characteristics required for a sliding surface of a piston and adhesiveness during casting, and a method for producing such MMC cylinder liner.

According to one aspect of the invention, an MMC cylinder liner having an inner tubular portion and an outer tubular portion is provided. The inner tubular portion includes metal matrix composite formed of a compact impregnated with an Al—Si alloy. The compact is made of a reinforcing material. The outer tubular portion is formed of the Al—Si alloy. An Si concentration of the Al—Si alloy impregnated into the compact of the inner tubular portion is different from an Si concentration of the Al—Si alloy of the outer tubular portion.

In one embodiment, the Si concentration of the Al—Si alloy in the outer tubular portion may be set so that the Al—Si alloy of the outer tubular portion has hypoeutectic composition.

In another embodiment, the Si concentration of the Al—Si alloy in the outer tubular portion may be between 8 wt % and 12 wt %.

In yet another embodiment, the Si concentration of the Al—Si alloy impregnated into the compact of the inner tubular portion may be between 6 wt % and 10 wt %.

In a further embodiment, the Si concentration of the Al—Si alloy impregnated into the compact of the inner tubular portion may be between 12 wt % and 16 wt %.

In another embodiment, the MMC cylinder liner may be produced by increasing a supply rate of a melted Al—Si alloy immediately before completion of filling of the melted Al—Si alloy into a cavity of at least one mold during casting of the Al—Si alloy.

In another embodiment, the supply rate before the increase in the supply rate may be set to between 20 and 40 cm/s and the supply rate after the increase in the supply rate may be set to between 0.5 and 4 m/s.

According to a second aspect of the invention, a method for producing an MMC cylinder liner comprising an inner tubular portion and an outer tubular portion is provided. The inner tubular portion includes a metal matrix composite formed of a compact impregnated with an Al—Si alloy. The compact is made of a reinforcing material. The outer tubular portion is formed of the Al—Si alloy. The method comprises: fitting a compact in a tubular form that has a generally circular cross-section over a core having generally cylindrical configuration, wherein the compact is made of a reinforcing material and has an outer periphery; providing at least one mold around the outer periphery of the compact to form a cavity in a tubular form that has a generally circular cross-section, wherein the at least one mold includes an end in the axial direction of the at least one mold; providing a melted Al—Si alloy via a gate disposed at or near the end; and increasing a supply rate of the melted Al—Si alloy immediately before completion of filling of the melted Al—Si alloy into the cavity.

In one embodiment, the supply rate before the increase in the supply rate may be set to between 20 and 40 cm/s and the supply rate after the increase in the supply rate may be set to between 0.5 and 4 m/s.

In another embodiment, Si concentration of the melted Al—Si alloy may be between 6 wt % and 12 wt %.

In yet another embodiment, Si concentration of the melted Al—Si alloy may be between 12 wt % and 16 wt %.

In another embodiment, the cavity may include a first end on the side of the gate, and a second end opposite to the first end, wherein an outer diameter of the cavity may be gradually enlarged from the first end toward the second end of the cavity.

In another embodiment, the compact may include a first end on the side of the gate, and a second end opposite to the first end, wherein the thickness of the compact becomes greater from the first end toward the second end of the compact.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

An MMC cylinder liner according to the first embodiment of the invention and a method for producing the same will be described with reference to FIGS. 1 to 8. First, configuration of the MMC cylinder liner of this embodiment will be explained with reference to FIGS. 1 to 3.

Figure 1:
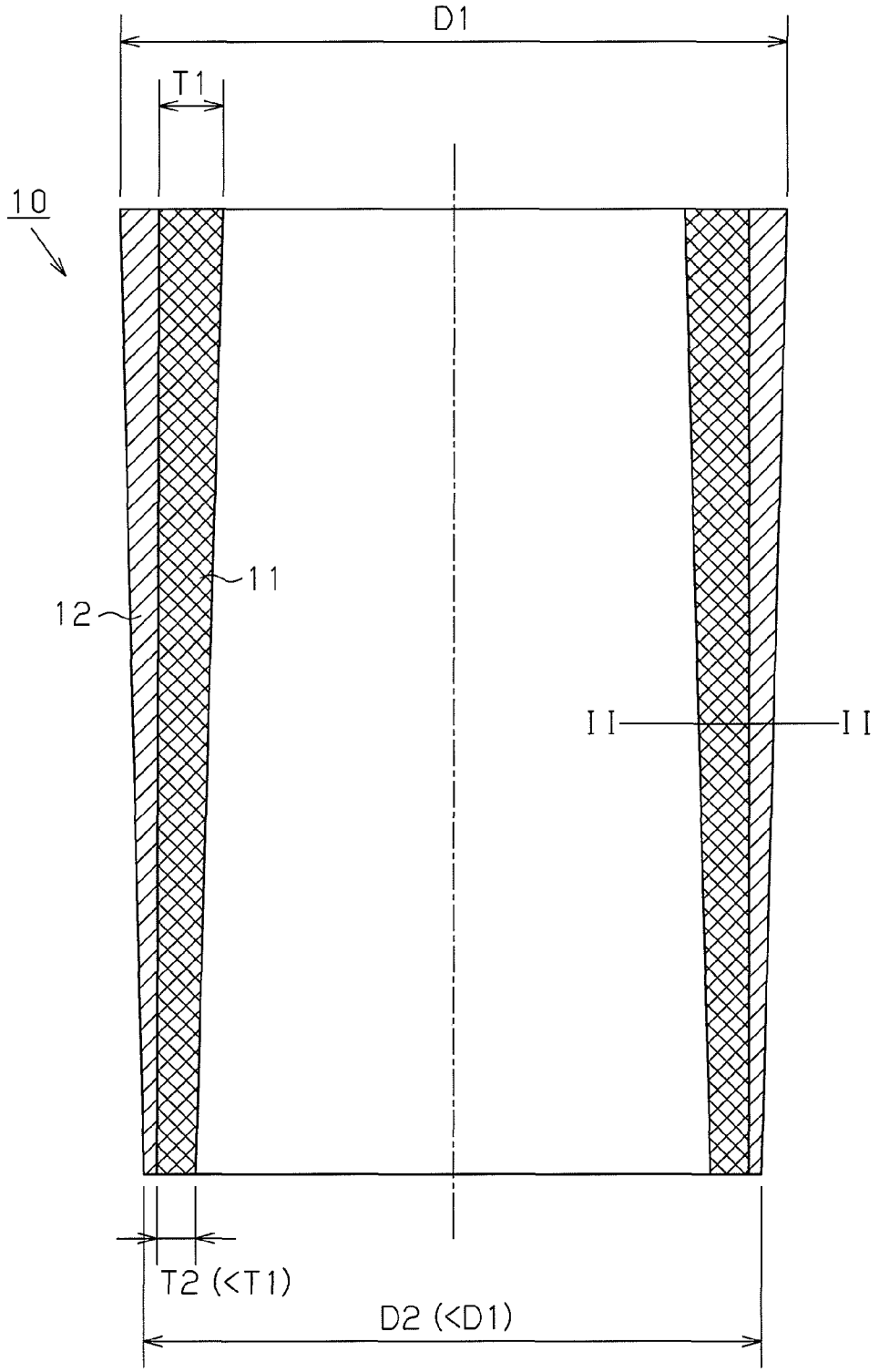
FIG. 1 illustrates a side cross-sectional view of an MMC cylinder liner according to a first embodiment of the invention.

FIG. 1 illustrates a side cross-sectional view of an MMC cylinder liner 10 according to the first embodiment. The MMC cylinder liner 10 is formed in a generally tubular form having a generally circular cross-section. The MMC cylinder liner 10 includes an inner tubular portion 11 and an outer tubular portion 12. The inner tubular portion 11 includes metal matrix composite (MMC) formed of a reinforcing material impregnated with an Al—Si alloy. The reinforcing material is made of a combination of metal and ceramic fibers or a combination of metal and ceramic particles. The outer tubular portion 12 is formed of the Al—Si alloy.

As illustrated in FIG. 1, the outer diameter of the outer tubular portion 12 is reduced as it goes from top to bottom. Specifically, the diameter D1 at the upper end of the outer tubular portion 12 is greater than the diameter D2 at the lower end of the outer tubular portion 12.

The thickness of the inner tubular portion 11 is also reduced as it goes from top to bottom. Specifically, the thickness T1 at the upper end of the inner tubular portion 11 is greater than the thickness T2 at the lower end of the inner tubular portion 11.

Figure 2:
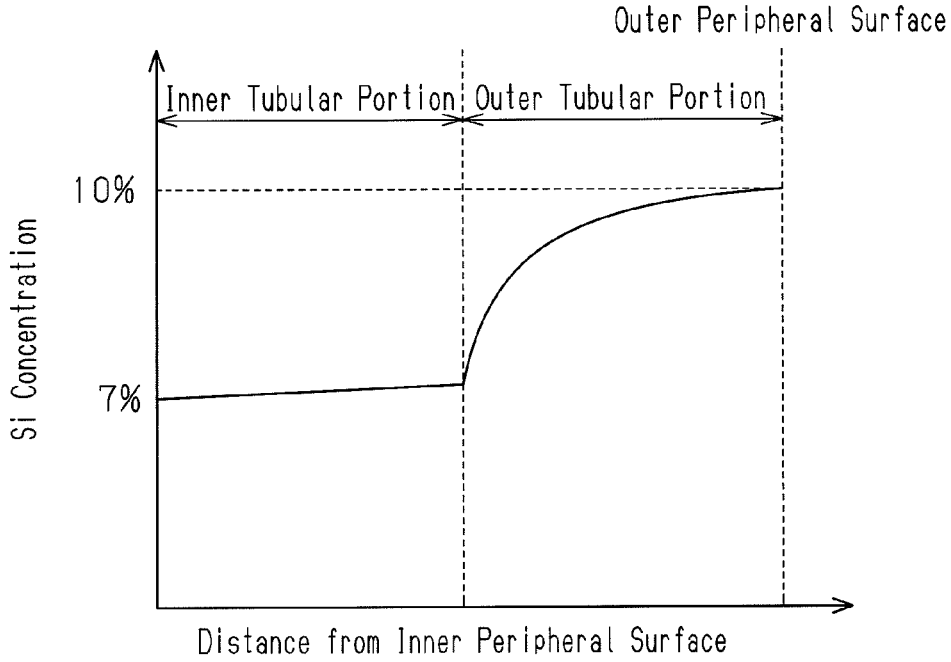
FIG. 2 is a graph representing Si concentration at the cross-section of the MMC cylinder liner of FIG. 1 taken along the line II-II of FIG. 1.

FIG. 2 illustrates distribution of Si concentration at the cross-section taken along the line II-II of FIG. 1. The measurement of Si concentration was conducted by analyzing the points of each of the inner tubular portion 11 and the outer tubular portion 12 with a scanning electron microscope (SEM) (S-4300, Hitachi High-Technologies Corporation, Japan) connected with an energy dispersive X-ray analyzer (EX-300, HORIBA, Limited, Japan). As illustrated, Si concentration of the Al—Si alloy impregnated into the reinforcing material of the inner tubular portion 11 is only about 7 wt % whereas Si concentration of the Al—Si alloy forming the outer tubular portion 12 is from about 8 wt % to about 10 wt % and increases toward the outer periphery of the cylinder liner.

Figure 3:
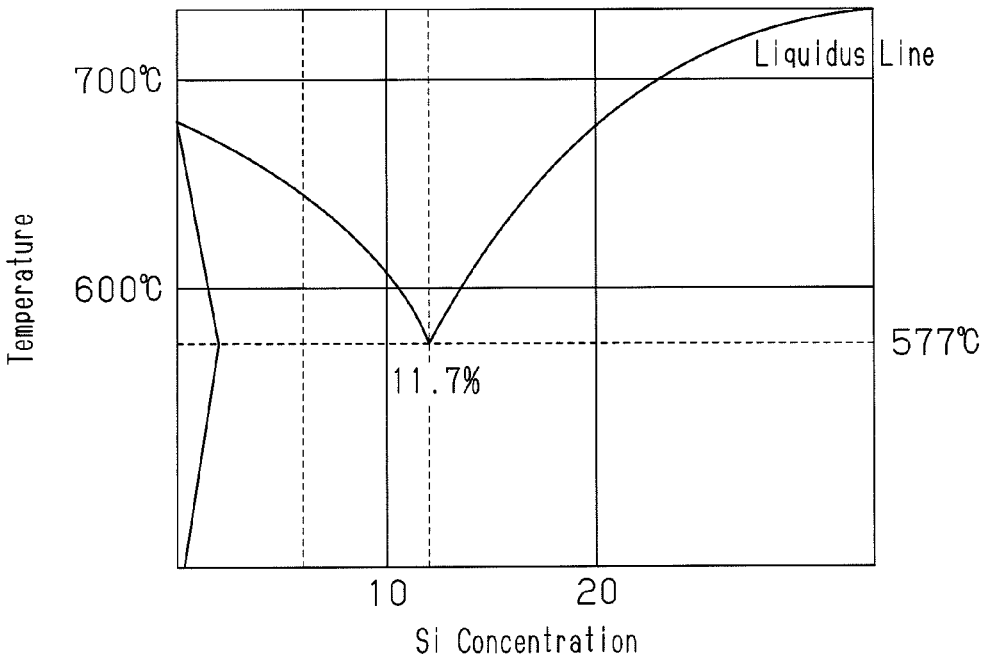
FIG. 3 is a binary phase diagram of an Al—Si alloy provided for use in the production of the MMC cylinder liner of FIG. 1.

FIG. 3 is a binary phase diagram of an Al—Si alloy which is material used for the production of the MMC cylinder liner 10. As illustrated, a melting point of the Al—Si alloy indicated by the liquidus line decreases until it reaches Si concentration of 11.7 wt %, which is an eutectic point. After reaching Si concentration of 11.7 wt %, the melting point rises as Si concentration increases. As clearly understood from this graph, the melting point of the hypoeutectic Al—Si alloy having Si concentration of 8 wt % to 10 wt % in the outer tubular portion 12 is lower than that of the Al—Si alloy having Si concentration of 7 wt % impregnated into the inner tubular portion 11.

Next, a method for producing the MMC cylinder liner 10 will be described with reference to FIGS. 4 to FIG. 8.

Figure 4:
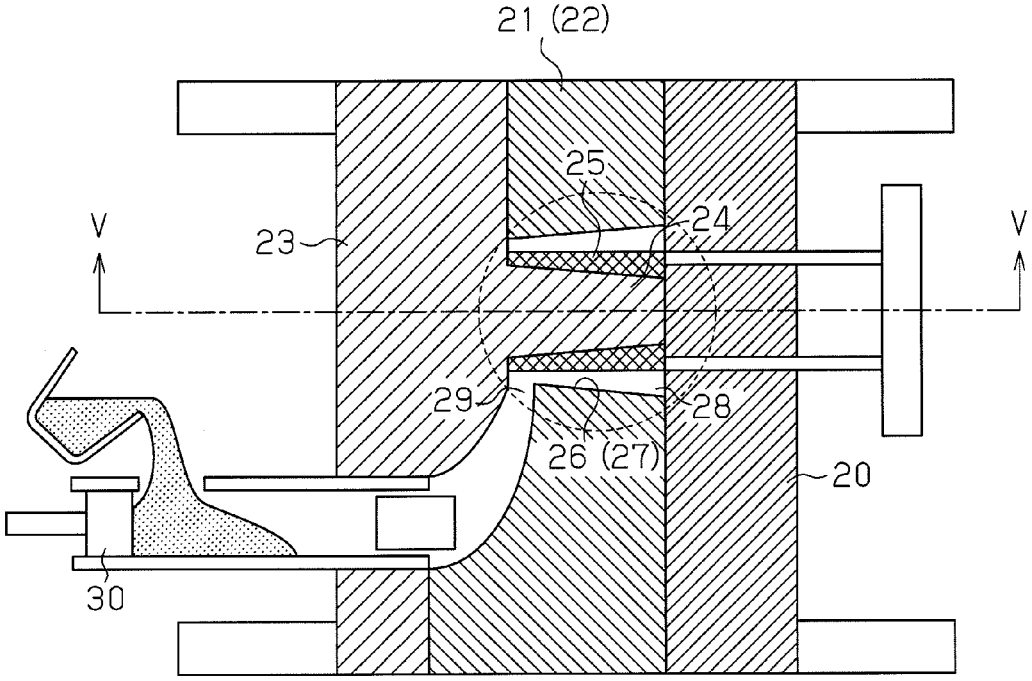
FIG. 4 is a side cross-sectional view of a die-cast device for use in the production of the MMC cylinder of FIG. 1.
Figure 5:
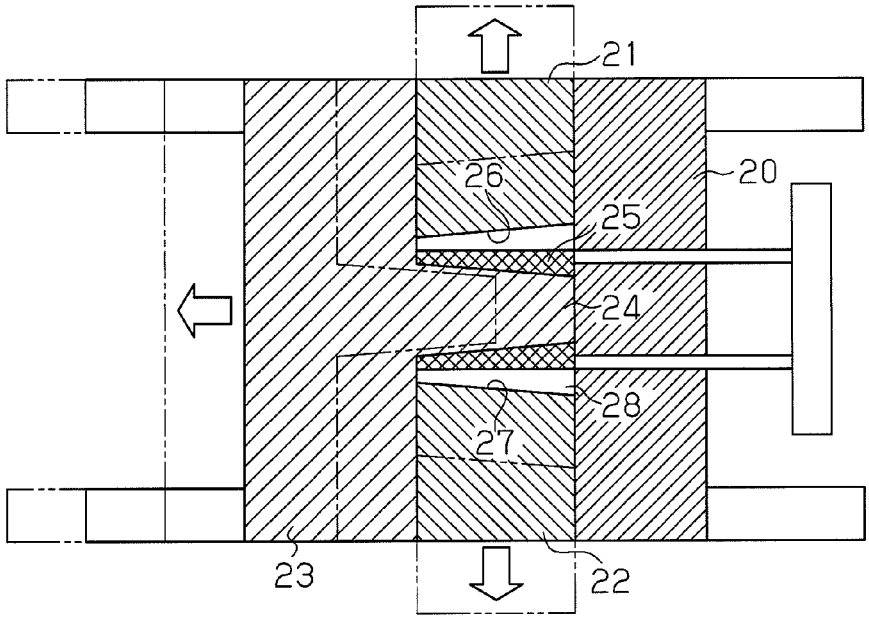
FIG. 5 is a plan sectional view of the die-cast device of FIG. 4 taken along the line V-V of FIG. 4.

FIG. 4 is a side cross-sectional view of a die-cast device for use in casting the MMC cylinder 10. FIG. 5 is a plan sectional view of the die-cast device taken along the line V-V of FIG. 4. As shown in these drawings, the die-cast device generally comprises 4 molds, i.e., a fixed mold 20, two lateral movable molds 21, 22, and a movable core mold 23. As illustrated in FIG. 5, the lateral movable molds 21, 22 may be advanced in a top to bottom direction or vise versa with respect to the fixed mold 20. The movable core mold 23 may be advanced in a right to left direction or vise versa with respect to fixed mold 20.

The movable core mold 23 includes a core 24 that has a generally cylindrical configuration and that protrudes and tapers toward its distal end in the direction of the fixed mold 20. A compact 25 made of a reinforcing material is preformed and fitted over the core 24. The compact 25 is shaped in a generally tubular configuration having a generally circular cross-section. The compact 25 is formed by hardening the reinforcing material of a combination of a metal and ceramic fibers or a combination of a metal and ceramic particles with a binder or a polymer coagulant to assure the generally tubular configuration, and sintering it. In the first embodiment, the compact 25 is formed so that the thickness of the compact 25 becomes greater as it goes from one end to the other end along the longitudinal direction of the compact 25. When the compact 25 is fitted over the core 24, a thicker end of the compact 25 is disposed on the same side as the distal end of the core 24.

As illustrated in FIG. 4, a gate 29 for supplying a melt of the Al—Si alloy is formed at or near the proximal portion of the core 24. The melt is supplied under the pressure through the gate 29 into the molds with a piston 30.

Figure 6:
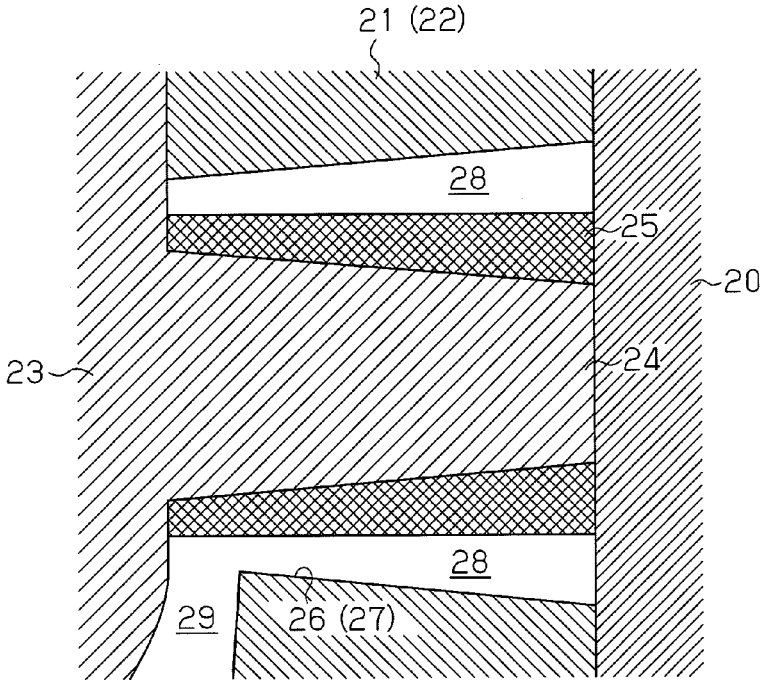
FIG. 6 is an enlarged cross-sectional view of the circular, dotted line portion of FIG. 4.

As shown in FIG. 6, which is an enlarged cross-sectional view of the circular, dotted line portion of FIG. 4, recesses 26 and 27 that are inversely semi-cylindrically concaved are formed in the two lateral movable molds 21 and 22 that each of the recesses 26 and 27 faces to the outer peripheral surface of the MMC cylinder liner 10. When the molds are assembled, a cavity 28 is formed between the recesses 26 and 27 and the outer peripheral surface of the compact 25 fitted over the core 24. The cavity 28 has a generally tubular configuration with a generally circular cross-section. The outer diameter of the cavity 28 becomes greater as it goes in the direction from the proximal end of the core 24 to the distal end of the core 24. Thus, the cross-section of the cavity 28 is increased as it goes away from the gate 29.

The MMC cylinder liner 10 is cast by supplying a melt of an Al—Si alloy, which is a base material, under the pressure through the gate 29 into the mold. In this embodiment, the Al—Si alloy having Si concentration of 6 wt % to 12 wt % is used as a melt to be supplied into the molds. Also, a supply rate or an injection rate of the melt may be changed during the supply of the melt. More specifically, the supply rate or the injection rate of the melt is set to from 20 to 40 cm/s during the period until immediately before completion of filling of the melt into the cavity 28, while the supply rate or the injection rate of the melt is set to from 0.5 to 4 m/s during the period after the above-mentioned time immediately before completion of filling.

Figure 7A:
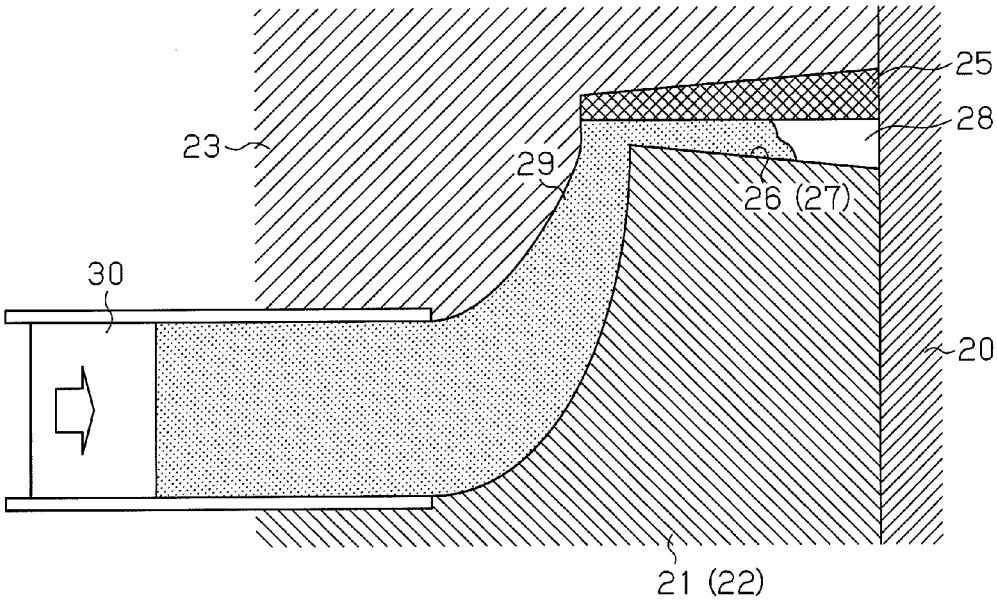
FIG. 7A illustrates supply of a melted Al—Si alloy at the stage immediately after the start of the supply in the production of the MMC cylinder liner of FIG. 1.

FIG. 7A illustrates supply of the melt at the stage immediately after the start of the supply. As illustrated, the melt supplied at low rate or speed fills the cavity 28. In this state, since the supply rate of the melt is low and the pressure generated by the supplied melt is low, the melt has not been impregnated into the compact 25 yet.

Figure 7B:
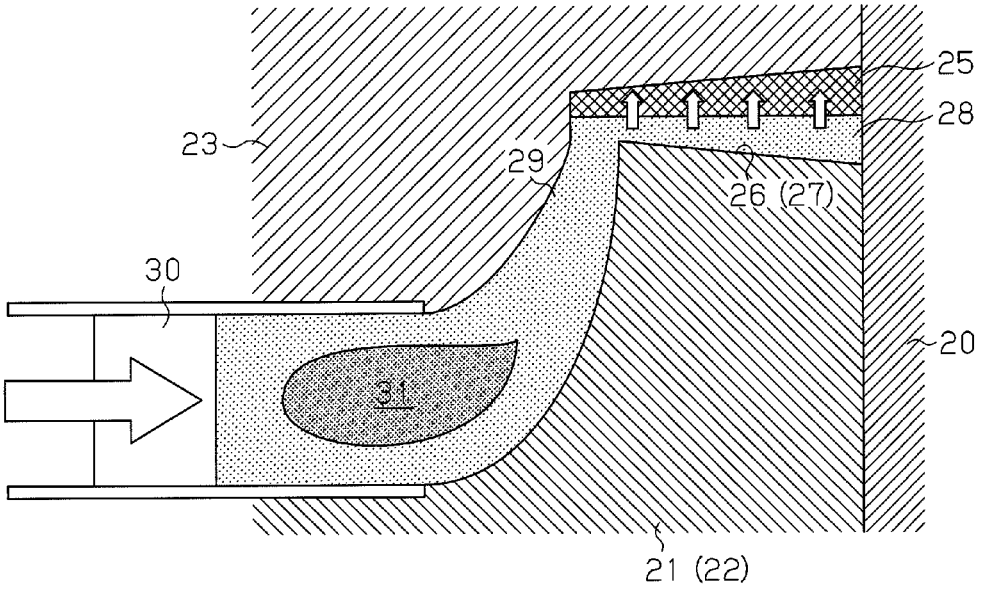
FIG. 7B illustrates supply of the melted Al—Si alloy at the stage until immediately before completion of filling of the melted Al—Si alloy into a cavity in the production of the MMC cylinder liner of FIG. 1.

FIG. 7B illustrates supply of the melt at the stage after completion of filling of the melt into the cavity 28. In this state, since the supply rate of the melt is increased and the pressure generated by the melt is also increased, impregnation of the melt into the compact 25 starts. It should be noted that, since the supply rate of the melt was low before this stage, the supplied melt started to solidify as the temperature of the supplied melt was decreased over time. The Si concentrations in the melt are not uniform and vary locally. As illustrated in the binary phase diagram of FIG. 3, at the Si concentration at or near the eutectic point of 11.7 wt %, the melting point of the Al—Si alloy is low. Thus, even if the temperature of the melt is decreased, a layer or a portion 31 having the Si concentration of from 8 wt % to 12 wt % maintains high fluidity.

Figure 7C:
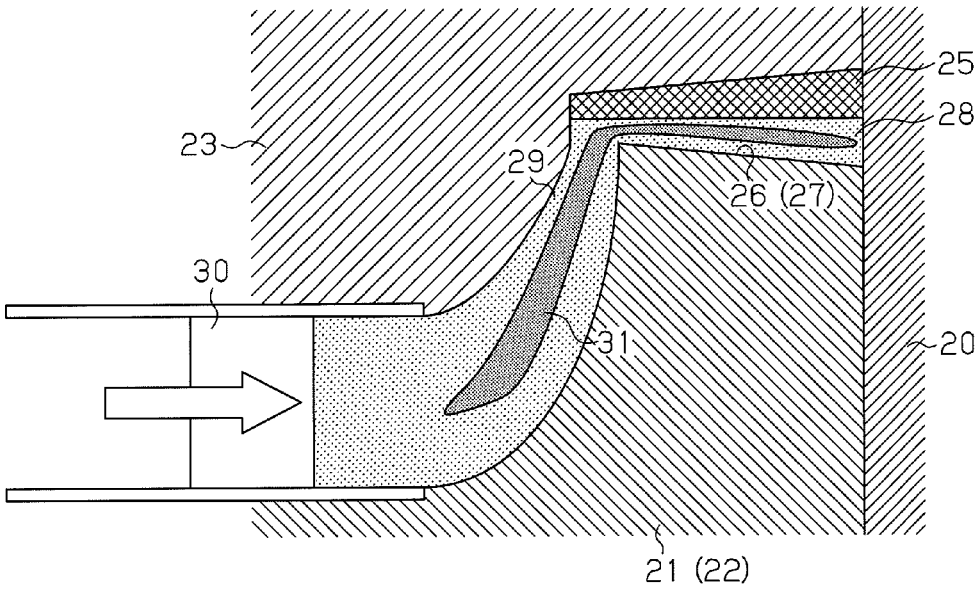
FIG. 7C illustrates supply of the melted Al—Si alloy at the stage after completion of filling of the melted Al—Si alloy into the cavity in the production of the MMC cylinder liner of FIG. 1.

FIG. 7C illustrates supply of the melt after further time goes by from the time point of FIG. 7B. As described above, only the melt having the Si concentration from 8 wt % to 12 wt % maintains high fluidity at this point. Thus, if the melt is supplied into the cavity 28 at high speed and at high pressure during this period, only the melt having the Si concentration from 8 wt % to 12 wt % is supplied into the cavity 28. Since impregnation of the compact 25 with the melt had been already completed, the melt having Si concentration from 8 wt % to 12 wt % fills only the cavity 28 to form an outer tubular portion 12 of the MMC cylinder liner 10. Thus, a difference of Si concentration occurs between in the inner tubular portion 11 and in the outer tubular portion 12, thereby producing the MMC cylinder liner 10 having the Si concentration distribution as illustrated in FIG. 2.

As described above, in the first embodiment, the molds are configured so that an outer diameter of the cavity 28 is gradually enlarged from the first end on the side of the gate 29 toward the second end opposing to the first end. In the manufacture of conventional MMC cylinder liners, the temperature of the melt was subject to decrease as it goes away from the gate 29 to cause solidification of the melt during the filling thereof, which may result in non-uniformity of composition of the melt. However, according to the method for producing the cylinder liner of the first embodiment, the cross-sectional area of the cavity 28 is enlarged. Thus, the temperature of the melt decreases more slowly than in the conventional device and the melt is filled uniformly into the cavity 28 before the compact 25 is impregnated with the melt. Thus, composition of the outer tubular portion 12 can be made uniform in the longitudinal direction of the MMC cylinder liner 10.

In this embodiment, the thickness of the compact 25 also becomes gradually greater as it goes from the first end on the side of the gate 29 toward the second end opposing to the first end. The compact 25 disposed in the molds during the filling of the melt serves as a heat insulating material to prevent decrease in temperature of the melt. By making the compact 25 thicker, the heat insulating effect is improved thereby preventing decrease in temperature of the melt at the portion remote from the gate. This also enables the composition of the outer tubular portion 12 to be uniform along the longitudinal direction of the MMC cylinder liner 10.

Figure 8:
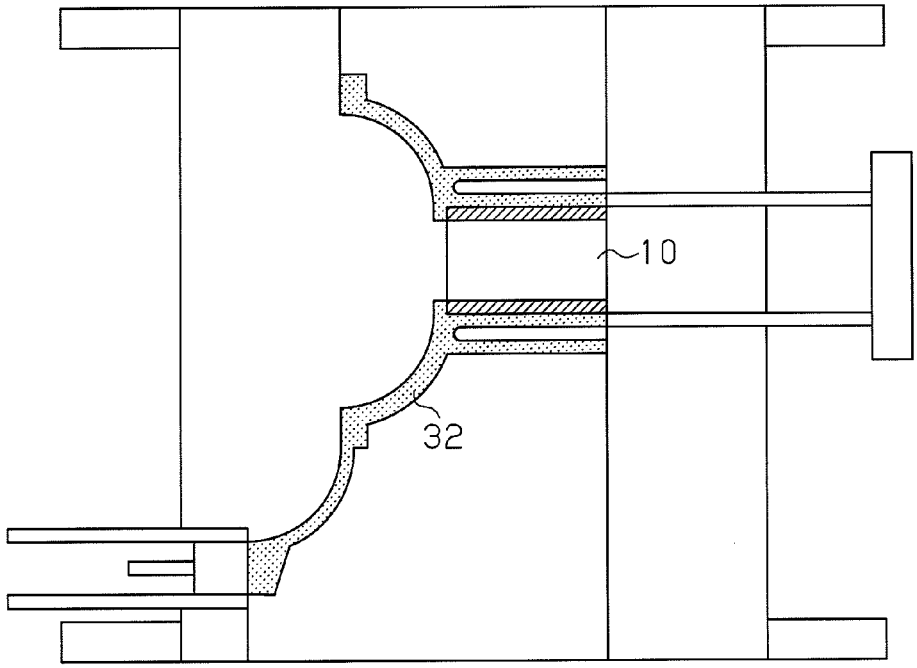
FIG. 8 illustrating casting of the MMC cylinder liner of FIG. 1 to a cylinder block.

As illustrated in FIG. 8, the MMC cylinder liner 10 produced as described above is cast during casting of a cylinder block so that the outer tubular portion 12 of the MMC cylinder liner 10 is fused with a main body 32 of the cylinder block. As described above, the outer tubular portion 12 of MMC cylinder liner 10 has hypoeutectic composition where Si concentration is from about 8 wt % to about 10 wt %. This makes the melting point of the outer tubular portion 12 low. Thus, the MMC cylinder liner 10 exhibits high adhesiveness with respect to the main body 32 of the cylinder block.

The MMC cylinder liner and the method for producing such cylinder liner according to the first embodiment have the following advantages.

(1) The MMC cylinder liner 10 of this embodiment comprises the inner tubular portion 11 and outer tubular portion 12, wherein the inner tubular portion 11 includes metal matrix composite formed of the compact 25 impregnated with an Al—Si alloy, the compact being made of a reinforcing material, and wherein the outer tubular portion 12 is formed of the Al—Si alloy. In this MMC cylinder liner 10, Si concentration of the Al—Si alloy impregnated into the compact 25 of the inner tubular portion 11 is different from the Si concentration of the Al—Si alloy of the outer tubular portion 12. More specifically, the Si concentration of the Al—Si alloy of the outer tubular portion 12 is set to from 8 wt % to 12 wt % while the Si concentration of the Al—Si alloy impregnated into the compact 25 of the inner tubular portion 11 is set to from 6 wt % to 10 wt % so that the Al—Si alloy of the outer tubular portion 12 has hypoeutectic composition having a lower melting point. This configuration of the outer tubular portion 12 ensures that the MMC cylinder liner 10 has high adhesiveness in casting with respect to the main body 32 of the cylinder block. Also, since the inner tubular portion 11, which serves as a sliding surface for a piston, has a lower percentage of hard Si component, the inner peripheral surface 11 contacts its counterpart softly. This reduces abrasion of a piston ring or a piston skirt which slides on the inner tubular portion 11. Accordingly, the MMC cylinder liner 10 of the first embodiment satisfies both the mechanical characteristics required for a sliding surface of a piston, and adhesiveness during casting.

(2) The method for producing a MMC cylinder liner 10 according to the first embodiment comprises: fitting the compact 25 in a tubular form that that has a generally circular cross-section over a core 24 having generally cylindrical configuration, wherein the compact is made of a reinforcing material and has an outer periphery; providing molds (20-23) around the outer periphery of the compact 25 to form a cavity 28 in a tubular form having a generally circular cross-section, wherein the at least one mold includes an end along the axial direction of the at least one mold; and providing a melted Al—Si alloy via a gate 29 disposed at or near the end. In the method for producing the MMC cylinder liner 10 according to the first embodiment, a supply rate of the melt during the period from the time immediately before filling of the melt into the cavity 28 to the time of completion of impregnation of the compact 25 with the melt is set higher than a supply rate of the melt immediately before completion of filling of the melt into the cavity 28. More specifically, the supply rate or the injection rate of the melt is increased from 20 to 40 cm/s to 0.5 to 4 m/s immediately before completion of filling of the melt into the cavity 28. When the supply rate of the melt is decreased, the melt starts to solidify over time. Since Si concentrations in the melt are not uniform and vary locally, the solidification begins with the melt having a higher melting point. After a certain time period has passed from the start of supply of the melt, only the melt having a lower melting point maintains high fluidity. That is, only the melt having Si concentration from 8 wt % to 12 wt % maintains high fluidity. At this point, when the supply rate of the melt is increased, the melt having the lower melting point to maintain fluidity is supplied into the molds. Thus, the change in supply rates causes the Si concentration of the melt impregnated into the compact 25 of the inner tubular portion 11 and the Si concentration of the melt supplied to the outer tubular portion 12 to differ from each other. Then, the outer tubular portion 12 has hypoeutectic composition having the lower melting point. In the method for producing the MMC cylinder liner according to the first embodiment, the melting point of the outer tubular portion 12 is lowered to ensure adhesiveness during casting, and Si concentration of the inner tubular portion 11 is made different from that of the outer tubular portion 12 to ensure both mechanical characteristics required for the inner peripheral surface of the cylinder liner, which serves as a sliding surface for a piston.

(3) In the method for producing the MMC cylinder liner according to the first embodiment, Si concentration of the melt supplied to the molds is set to 6 wt % to 10 wt %. Specifically, whereas a layer or a portion of an alloy having a low melting point is formed in the outer tubular portion 12, Si concentration of the Al—Si alloy of the inner tubular portion 11 impregnated into the compact 25 can be set to 6 wt % to 10 wt %. In this case, the inner tubular portion 11 contains a smaller amount of hard Si component and thus contacts its counterpart softly, thereby reducing abrasion of a piston ring or a piston skirt which slides on inner tubular portion 11.

(4) In the method for producing the MMC cylinder liner according to the first embodiment, the outer diameter of the cavity 28 is gradually enlarged from first end on the side of the gate 29 toward the second end opposing to the first end. This prevents decrease in temperature of the melt at the portion away from the gate 29. Thus, composition of the outer tubular portion 12 can be kept uniform along the longitudinal direction of the MMC cylinder liner 10.

(5) In the method for producing the MMC cylinder liner according to the first embodiment, the thickness of the compact 25 becomes gradually greater as it goes from the first end on the side of the gate 29 toward the second end opposing to the first end. The compact 25 disposed in the molds during the filling of the melt serves as a heat insulating material to prevent decrease in temperature of the melt. By making the compact 25 thicker, the heat insulating effect is improved thereby preventing decrease in temperature of the melt at the portion away from the gate 29. Thus, composition of the outer tubular portion 12 can be kept uniform along the longitudinal direction of the MMC cylinder liner 10.

Second Embodiment

An MC cylinder liner and a method of making the same according to the second embodiment of the invention will be described with reference to FIG. 9 by focusing different points from the first embodiment.

The shape of the MMC cylinder liner of the second embodiment is the same as that of the first embodiment in that the MMC cylinder liner of the second embodiment also includes an inner tubular portion 11 formed of the metal matrix composite (MMC) and an outer tubular portion 12 formed of an Al—Si alloy, wherein the metal matrix composites (MMC) includes a compact made of reinforcing material impregnated with the Al—Si alloy. The MMC cylinder liner 10 of the second embodiment is also the same as that of the first embodiment in that the outer diameter of the outer tubular portion 12 is gradually reduced as it goes from one end to the other end in the direction of the longitudinal direction thereof, and the thickness of the inner tubular portion 11 is also gradually reduced from one end to the other end in the direction of the longitudinal direction thereof. However, in the MMC cylinder liner of the second embodiment, distribution of Si concentration is different from that of the first embodiment.

Figure 9:
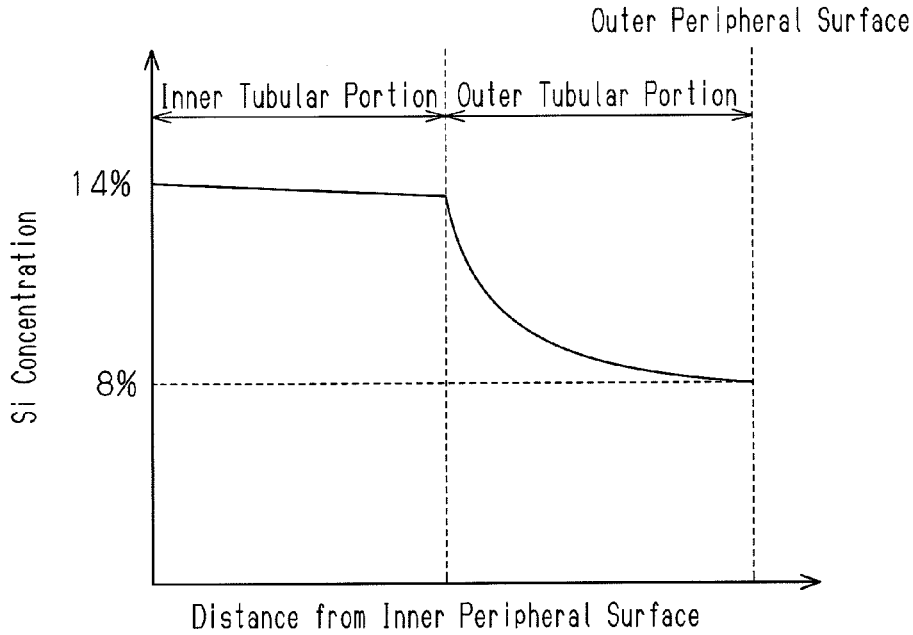
FIG. 9 is a graph representing Si concentration at the cross-section of an MMC cylinder liner according to the second embodiment of the invention taken along the line corresponding to the line II-II of FIG. 1.
Figure 10A:
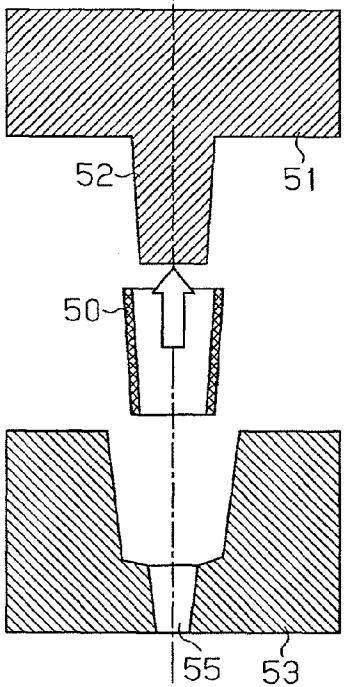
Fig.10A PRIOR ART
FIGS. 10A to D illustrate steps of producing a conventional MMC cylinder liner.
Figure 10B:
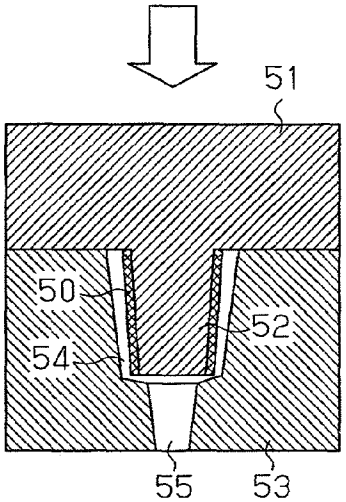
Fig.10B PRIOR ART
Figure 10C:
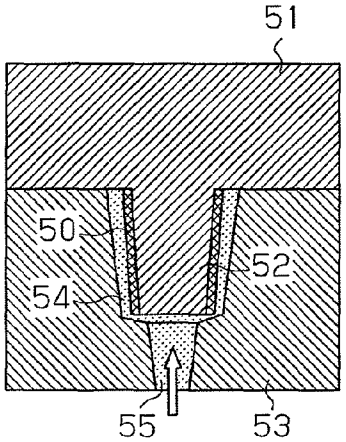
Fig.10C PRIOR ART
Figure 10D:
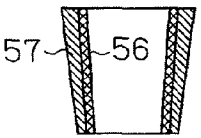
Fig.10D PRIOR ART

FIG. 9 illustrates distribution of Si concentration of the MMC cylinder liner according to the second embodiment. The measurement of Si concentration was conducted in the same manner as in FIG. 2. The distribution of Si concentration of this figure is taken at the cross-section of the MMC cylinder liner of the second embodiment along the line corresponding to the line II-II of FIG. 1. As illustrated, Si concentration of Al—Si alloy impregnated into the reinforcing material of the inner tubular portion is about 14 wt % while Si concentration of the Al—Si alloy forming the outer tubular portion is from about 8 wt % to 12 wt % and is decreased toward the outer periphery of the cylinder liner. As clearly understood from the graph of FIG. 3, the melting point of the hypoeutectic Al—Si alloy, which has Si concentration of 8 wt % to 12 wt % in the outer tubular portion 12, is lower than that of the Al—Si alloy, which has Si concentration of 14 wt % impregnated into the inner tubular portion 11.

A method for producing the MMC cylinder liner of second embodiment is basically the same as that of the first embodiment except that the Al—Si alloy supplied to the molds as the melt has Si concentration of 12 wt % to 16 wt % in the second embodiment.

However, the supply rate or the injection rate of the melt is set to from 20 to 40 cm/s during the period from the start of the supply of the melt until immediately before completion of filling of the melt in the cavity 28, whereas the supply rate or the injection rate of the melt is set to from 0.5 to 4 m/s during the period from the time immediately before completion of filling of the melt to completion of impregnation of the compact 25 with the melt. Again, as time goes by from the start of the supply of the melt, the melt begins to solidify but a layer having the Si concentration of from 8 wt % to 12 wt % maintains high fluidity at that point. Accordingly, by increasing the speed of the supply of the melt immediately after completion of the filling of the cavity, the melt having Si concentration from 8 wt % to 12 wt % can be supplied under pressure into the cavity, thereby producing an outer tubular portion having hypoeutectic composition. In this case, Si concentration of the melt impregnated into the compact is from 12 wt % to 16 wt %. Thus, the MMC cylinder liner having Si concentration distribution as illustrated in FIG. 9 is produced.

The MMC cylinder liner and the method of making the same according to the second embodiment have the following advantages, in addition to the aforementioned advantages (2), (4) and (5).

(6) In this embodiment, the Si concentration of the Al—Si alloy of the outer tubular portion is set to from 8 wt % to 12 wt % whereas the Si concentration of the Al—Si alloy impregnated into the compact of the inner tubular portion is set to 12 wt % to 16 wt % so that Al—Si alloy of the outer tubular portion has hypoeutectic composition having a low melting point. In this MMC cylinder liner, high adhesiveness of the cylinder liner to the body of the cylinder block is ensured since the outer tubular portion has hypoeutectic composition having a low melting point. Also, since the Si concentration of the inner tubular portion, which serves as a sliding surface for a piston, is as high as 12 wt % to 16 wt %, strength of the alloy is enhanced, thereby reducing a reinforcing material to be used.

(7) In the method for producing the MMC cylinder liner according to this embodiment, the Si concentration of the melt supplied to the molds is set to from 12 wt % to 16 wt %. Thus, while a layer of an alloy having a low melting point is formed as the outer tubular portion, the compact of the reinforcing material impregnated with an Al—Si alloy having Si concentration of from 12 wt % to 16 wt % can be formed as the inner tubular portion. In this case, strength of the alloy is enhanced due to larger amount of Si component in the alloy, thereby reducing a reinforcing material to be used.

The above embodiments may be modified as follows.

In the above embodiments, the outer diameter of the cavity 28 is gradually enlarged from the first end on the side of the gate 29 to the second end opposing the first end, and the thickness of the compact 25 is also gradually enlarged from the first end on the side of the gate 29 to the second end opposing the first end so that the decrease in the temperature of the melt at the portion remote from the gate 29 is prevented, thereby keeping the composition uniform. However, configuration of the cavity 28 or the compact 25 is not limited as such and these members may assure any configuration as long as decrease in the temperature of the melt at the portion remote from the gate 29 can be compensated by some method such as heating the molds.

In the above embodiments, the supply rate or the injection rate of the melt is set to from 20 to 40 cm/s during the period until immediately before completion of filling of the melt into the cavity 28, while the supply rate or the injection rate of the melt is set to from 0.5 to 4 m/s during the period from immediately before completion of filling of the melt to completion of impregnation of the compact 25 with the melt. However, the supply rate of the melt during the period until immediately before completion of filling of the melt into the cavity 28 may be delayed as long as the melt is cooled to the extent so that only a layer of the melt having Si concentration of from 8 wt % to 12 wt % maintains high fluidity by the time of completion of filling of the melt. In addition, the supply rate during the period from immediately before completion of filling of the melt to completion of the impregnation of the compact 25 with the melt may be set to any value as long as a layer of the melt having Si concentration of from 8 wt % to 12 wt % is supplied into the cavity 28.

A method for measuring Si concentration with a SEM connected with an X-ray analyzer is well known technique. Accordingly, the method for Si concentration is not limited to the method described in the above embodiments, but may be measured with any other commercially available device(s).

In the above embodiments, a die-cast device including four molds, i.e., the fixed mold 20, the lateral movable molds 21, 22 and the movable core mold 23, is used for casting the MMC cylinder liner 10. However, the configuration of the molds of the die-cast device is not limited to this configuration, and may be modified as appropriate.

The invention claimed is:

1. A method for producing a MMC cylinder liner comprising an inner tubular portion including a metal matrix composite formed of a compact impregnated with an Al—Si alloy, the compact being made of a reinforcing material; and an outer tubular portion formed of the Al—Si alloy, wherein the method comprises:

fitting a compact in a tubular form that has a generally circular cross-section over a core having generally cylindrical configuration, wherein the compact is made of a reinforcing material and has an outer periphery;

providing at least one mold around the outer periphery of the compact to form a cavity in a tubular form that has a generally circular cross-section, wherein the at least one mold includes an end in the axial direction of the at least one mold;

providing a melted Al—Si alloy via a gate disposed at or near the end; and increasing a supply rate of the melted Al—Si alloy immediately before completion of filling of the melted Al—Si alloy into the cavity.

2. The method of claim 1, wherein the supply rate before the increase in the supply rate is set to between 20 and 40 cm/s and the supply rate after the increase in the supply rate is set to between 0.5 and 4 m/s.

3. The method of claim 1, wherein Si concentration of the melted Al—Si alloy is between 6 wt % and 12 wt %.

4. The method of claim 1, wherein Si concentration of the melted Al—Si alloy is between 12 wt % and 16 wt %.

5. The method of claim 1, wherein the cavity includes a first end on the side of the gate, and a second end opposite to the first end, wherein an outer diameter of the cavity is gradually enlarged from the first end toward the second end of the cavity.

6. The method of claim 1, wherein the compact includes a first end on the side of the gate, and a second end opposite to the first end, wherein the thickness of the compact becomes greater from the first end toward the second end of the compact.

7. A method for producing a MMC cylinder liner comprising an inner tubular portion including a metal matrix composite formed of a compact impregnated with an Al—Si alloy, the compact being made of a reinforcing material; and an outer tubular portion formed of the Al—Si alloy, wherein the method comprises:

fitting a compact in a tubular form that has a generally circular cross-section over a core having generally cylindrical configuration, wherein the compact is made of a reinforcing material and has an outer periphery;

providing at least one mold around the outer periphery of the compact to form a cavity in a tubular form that has a generally circular cross-section, wherein the at least one mold includes an end in the axial direction of the at least one mold;

providing a melted Al—Si alloy via a gate disposed at or near the end; and changing a supply rate of the melted Al—Si alloy so as to supply the melted Al—Si alloy at a second supply rate during a time period starting from a time immediately before completion of filling of the melted Al—Si alloy into the cavity until a time of the completion of impregnation of the compact filling, which is higher than a first supply rate during a time period ending immediately before completion of filling of the melted Al—Si alloy into the cavity.

8. The method of claim 7, wherein the first supply rate before the changing the supply rate is set to between 20 and 40 cm/s and the second supply rate after the change in the supply rate is set to between 0.5 and 4 m/s.

9. The method of claim 7, wherein Si concentration of the melted Al—Si alloy is between 6 wt % and 12 wt %.

10. The method of claim 7, wherein Si concentration of the melted Al—Si alloy is between 12 wt % and 16 wt %.

11. The method of claim 7, wherein the cavity includes a first end on the side of the gate, and a second end opposite to the first end, wherein an outer diameter of the cavity is gradually enlarged from the first end toward the second end of the cavity.

12. The method of claim 7, wherein the compact includes a first end on the side of the gate, and a second end opposite to the first end, wherein the thickness of the compact becomes greater from the first end toward the second end of the compact.

* * * * *